US005339839A

United States Patent [19]

Forcelledo et al.

[11] Patent Number: 5,339,839

[45] Date of Patent: Aug. 23, 1994

[54] COMB WITH FLUID APPLICATOR

[75] Inventors: Jack L. Forcelledo, 9255 Doheny Rd., Suite 2504, Los Angeles, Calif. 90069; Steven D. Kimmell, 12754 Deon Pl., Granada Hills, Calif. 91344

[73] Assignee: Jack L. Forcelledo, Los Angeles, Calif.

[21] Appl. No.: 54,443

[22] Filed: Apr. 28, 1993

[51] Int. Cl.[5] ..... A45D 24/22

[52] U.S. Cl. ..... 132/114; 132/112

[58] Field of Search ..... 132/112, 113, 114, 115, 132/116

[56] References Cited

U.S. PATENT DOCUMENTS

| | | | |
|---|---|---|---|
| 1,051,714 | 1/1913 | Edwards . | |
| 1,232,005 | 7/1917 | Cottle . | |
| 1,637,249 | 7/1927 | Ames | 132/115 |
| 1,667,631 | 4/1928 | Mach | 132/114 |
| 2,228,213 | 1/1941 | Hillsberry . | |
| 3,137,305 | 6/1964 | Jones | 132/116 X |
| 3,147,757 | 9/1964 | Hofmann | 132/114 |
| 3,463,170 | 8/1969 | McCullough | 132/113 |
| 3,754,557 | 8/1973 | Moore | 132/114 |
| 4,090,522 | 5/1978 | Donley et al. | 132/112 |
| 4,323,085 | 4/1982 | Röhm | 132/113 |
| 4,605,026 | 8/1986 | Nolin | 132/112 |
| 4,792,250 | 12/1988 | Turner | 401/43 |
| 5,056,480 | 10/1991 | Murray, Sr. | 132/114 |
| 5,125,423 | 7/1992 | Butterbrodt | 132/112 |

FOREIGN PATENT DOCUMENTS 2422359 12/1979 France .

*Primary Examiner*—Robert P. Swiatek

*Assistant Examiner*—Cindy A. Cherichetti

*Attorney, Agent, or Firm*—Spensley Horn Jubas & Lubitz

[57] ABSTRACT

A device for applying a liquid to the hair of an individual, the device comprising a comb member and a container, wherein: the comb member has an elongate tubular main body with opposed axial ends and a longitudinal axis extending between the ends, the main body encloses a longitudinal passage which extends along the longitudinal axis, is open at one of the axial ends and is closed at the other one of the axial ends, and the longitudinal passage includes means at the one axial end for receiving the container, and a plurality of elongate teeth carried by the tubular main body and extending parallel to one another from the main body in a direction transverse to the longitudinal axis, each of the teeth having a base connected to the main body, a tip remote from the base, and a linear passage extending in a straight line from the base to the tip, the linear passage being open at the base to communicate with the longitudinal passage in the main body and being open at the tip, each of the teeth having a frustoconic form which tapers from the base to the tip and the linear passage in each of the teeth having a frustoconic form which is at least approximately congruent with that of the associated one of the teeth, and the container: has an open end insertable into the means for receiving the container; is filled with a mass of liquid to be applied to the hair; and is made entirely of a flexible material which allows any portion of the container to be squeezed in order to force the liquid through the longitudinal passage and the linear passages and out of the linear passages at the tips of the teeth.

1 Claim, 2 Drawing Sheets

COMB WITH FLUID APPLICATOR

BACKGROUND OF THE INVENTION

The present invention relates to a device for dispensing a fluid into the hair of an individual, and particularly a device which facilitates thorough and complete contact between the fluid and the entire mass of hair, down to the scalp.

There are a variety of hair care products, including conditioners, dyes, shampoos, etc., which will be most effective if they can be dispensed fully into hair, from the tips down to the roots. When an individual has hair which is long and/or thick, it is often difficult to fully achieve this result.

A considerable variety of dispensing devices has already been proposed in the art, a relevant example being that disclosed in French Patent No. 2,422,359. This patent discloses a structure including a comb part provided with teeth, the teeth having narrow passages of uniform diameter via which a product is dispensed. A container of a substance to be dispensed may be removably attached, by a threaded connection, to the comb part. The container is basically a rigid body having a limited portion which is flexible and deformable. Squeezing of this flexible and deformable portion acts to dispense a fluid product through the passages in the comb teeth. Because only a limited portion of the container is flexible and deformable, it is not possible to compress the container to the extent desired to dispense a large proportion of the product contained therein. Therefore, in the use of this device, a considerable amount of product will be left in the container, resulting in uneconomical and inefficient utilization of that product.

Another device of this type is disclosed in U.S. Pat. No. 1,667,631. This device includes a comb having fine teeth at one end and coarse teeth at the other end, with only the coarse teeth being provided with dispensing passages. These dispensing passages extend along a substantial portion of the length of each coarse tooth to a location near the end thereof, where they terminate in transverse passages. The longitudinal passages have a constant cross section. Fabrication of passages of this type is extremely difficult to achieve and would require a costly manufacturing procedure.

A number of other devices of this type have been proposed, all of which are relatively complex and/or inconvenient to use.

SUMMARY OF THE INVENTION

It is an object of the present invention to provide an improved device of the above-described type which is free of shortcomings of known devices.

A more specific object of the invention is to provide a device of this type which can be manufactured easily and inexpensively.

Another object of the invention is to provide a device of this type which permits easy dispensing of a substantial portion of the fluid product provided in the container.

A device for applying a liquid to the hair of an individual, the device comprising a comb member and a container, wherein: the comb member has an elongate tubular main body with opposed axial ends and a longitudinal axis extending between the ends, the main body encloses a longitudinal passage which extends along the longitudinal axis, is open at one of the axial ends and is closed at the other one of the axial ends, and the longitudinal passage includes means at the one axial end for receiving the container, and a plurality of elongate teeth carried by the tubular main body and extending parallel to one another from the main body in a direction transverse to the longitudinal axis, each of the teeth having a base connected to the main body, a tip remote from the base, and a linear passage extending in a straight line from the base to the tip, the linear passage being open at the base to communicate with the longitudinal passage in the main body and being open at the tip, each of the teeth having a frustoconic form which tapers from the base to the tip and the linear passage in each of the teeth having a frustoconic form which is at least approximately congruent with that of the associated one of the teeth, and the container: has an open end insertable into the means for receiving the container; is filled with a mass of liquid to be applied to the hair; and is made entirely of a flexible material which allows any portion of the container to be squeezed in order to force the liquid through the longitudinal passage and the linear passages and out of the linear passages at the tips of the teeth.

DESCRIPTION OF THE PREFERRED EMBODIMENTS

Figure 1:
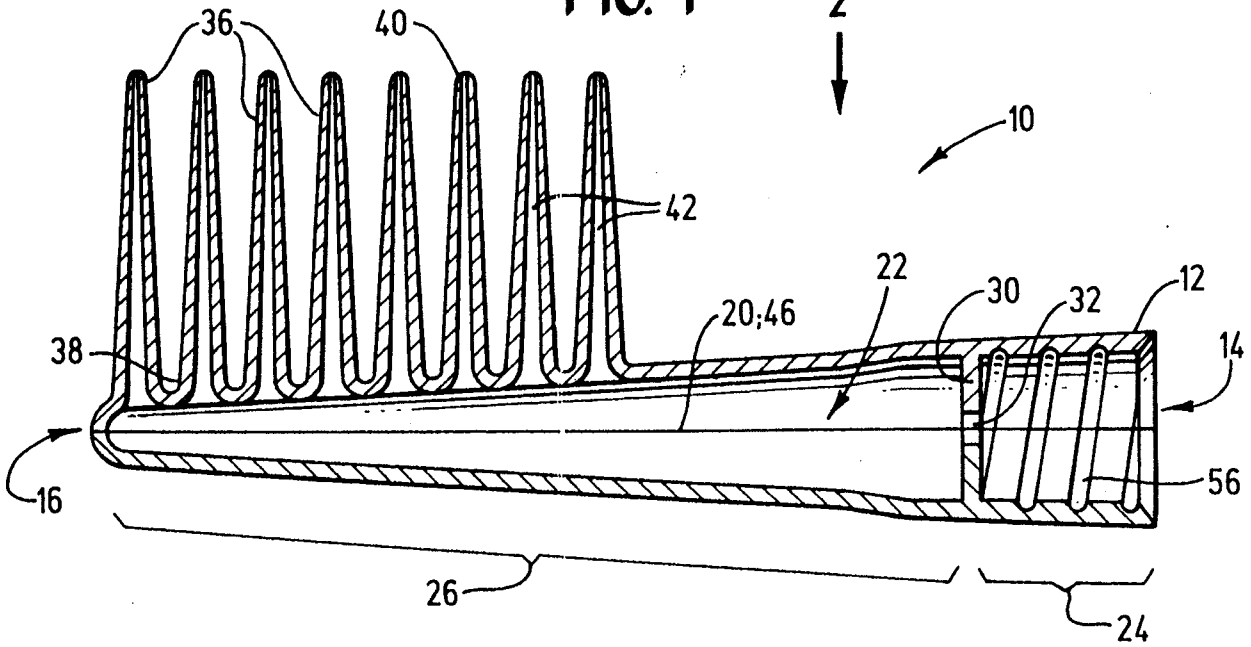
FIG. 1 is a longitudinal, cross-sectional view of a preferred embodiment of the comb member of a device according to the invention.
Figure 2:
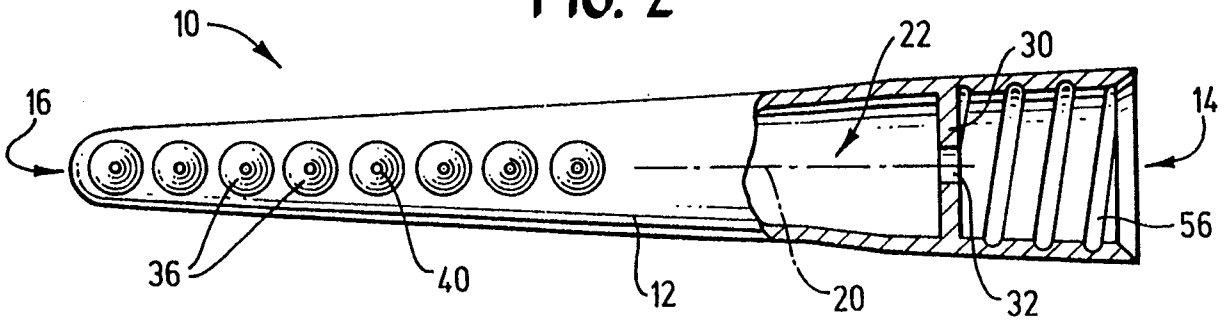
FIG. 2 is a side view, partly in cross section, in the direction of the arrow 2 of FIG. 1.

FIGS. 1 and 2 illustrate a comb member 10 of a preferred embodiment of a device according to the present invention. Comb member 10 is composed of an elongate tubular main body 12 having opposed axial ends 14 and 16. Main body 12 has a longitudinal axis 20 which extends between axial ends 14 and 16 and main body 12 is formed to have a longitudinal passage 22 which extends along, and is centered on, longitudinal axis 20. Longitudinal passage 22 is open at axial end 14 for receiving a liquid to be applied. Longitudinal passage 22 is closed at the other axial end 16.

Longitudinal passage 22 has two portions: a cylindrical portion 24 adjacent axial end 14, where longitudinal passage 22 is open; and a cylindrical portion 26 which tapers gradually and uniformly from portion 24 to axial end 16. The two portions 24 and 26 are separated from one another by a diaphragm plate 30 having a small diameter opening 32 centered on longitudinal axis 20. Diaphragm plate 30 helps to rigidify portion 24 to provide a better seal between comb member 10 and the container (to be described below).

Comb member 10 further includes a plurality of elongate teeth 36 which are carried by tubular main body 12 and extend parallel to one another and perpendicular to longitudinal axis 20. Each tooth 36 includes a base 38 which is connected to main body 12 and a tip 40 remote from base 38. Each tooth 36 is a hollow tubular part providing a linear passage 42 extending in a straight line from base 38 to tip 40 and opening at tip 40.

Each tooth 36 has a frustoconic form, as does each linear passage 42. The frustoconic forms of teeth 36 and linear passages 42 are made at least approximately congruent so that each tooth 36 has an at least approximately unvarying wall thickness. This form of construction facilitates fabrication of comb member 10 by a molding process.

Manufacture is further facilitated by the linear form of linear passages 42. As a result of this linear form, liquid exits from linear passages 40 in a direction parallel to the straight line axes of these passages.

Preferably, comb member 10 is composed of two separately molded parts which, after molding, are joined together by a suitable adhesive along a meeting plane 46 which contains longitudinal axis 20 and extends perpendicular to the axes of teeth 36. According to a preferred embodiment of the invention, the diameter of each linear passage 43 at the tip 40 of its associated tooth 36 may be of the order of 0.02 to 0.04 inch. A total of eight teeth 36 may be provided, with a spacing between teeth 36 of the order of 0.39 inch. Teeth 36 have a length sufficient to enable tips 40 to reach the hair roots, or the scalp, even in a head of thick hair. A length of about 2 inches (5 cm) has been found to be suitable.

Comb member 10 is also constructed to have an at least approximately unvarying wall thickness and to give longitudinal passage 22 a gradual and uniform taper from a point near plate 30 to axial end 16. This form helps to assure uniform distribution of liquid to passages 42 in all teeth 36.

Figure 3:
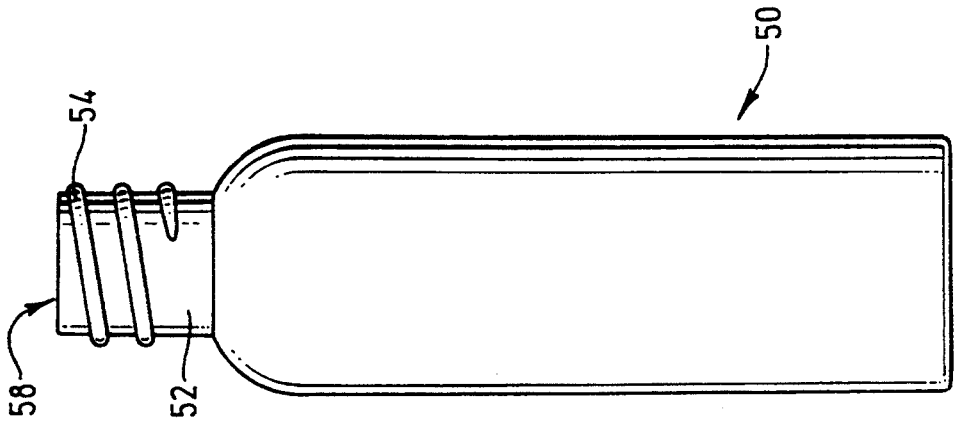
FIG. 3 is a side view of a container which is to be assembled to the comb member of FIGS. 1 and 2 to form a complete device according to the preferred embodiment of the invention.

FIG. 3 is a side elevational view of a typical container 50 which may be assembled with comb member 10 of FIGS. 1 and 2. Container 50 is provided with a neck 52 carrying threads 54 dimensioned to mate with internal threads 56 in comb member portion 24. Container 50 is made entirely of a material which, while being shape-retaining, is easily compressible, as by squeezing, in order to force liquid out via open end 56. Container 50 is defined by a wall having a homogenous composition around its circumference, so that container 50 can be squeezed at any points around its circumference.

Prior to assembly with comb member 10, container 50 would normally be closed by an internally threaded cap (not shown) to protect its contents. When the contents of container 50 have been used up, container 50 will simply be unscrewed from comb member 10, and replaced with a fresh container.

Figure 4:
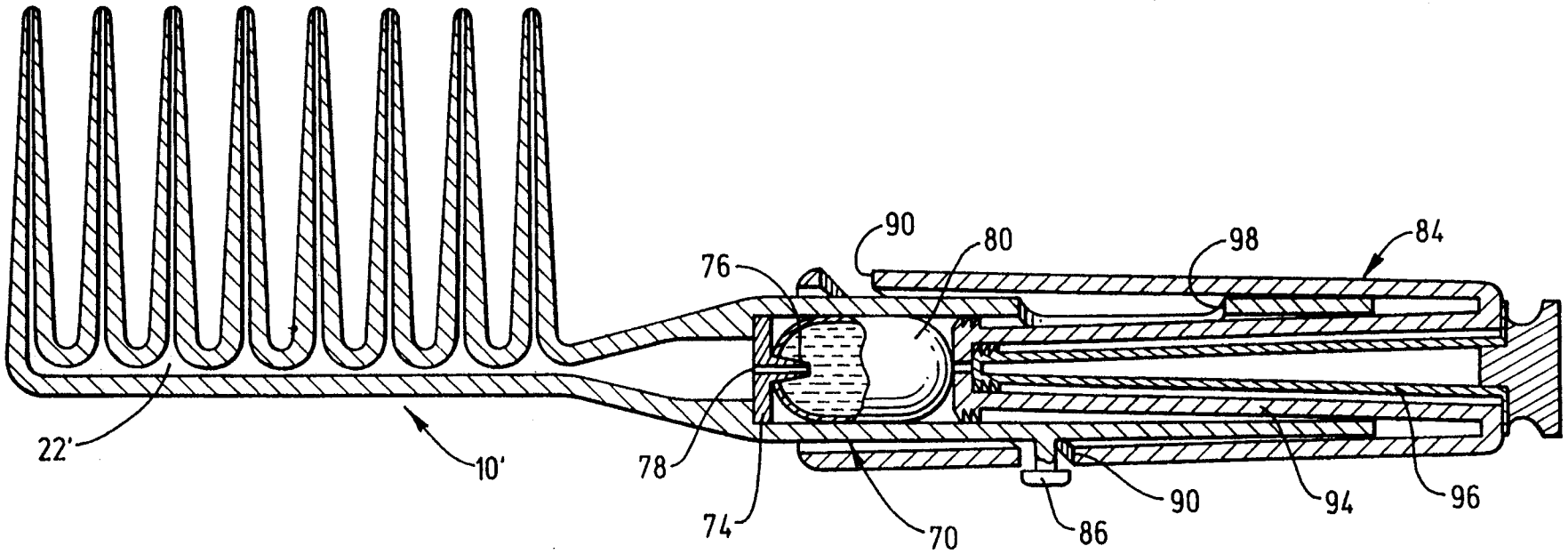
FIG. 4 is a longitudinal cross-sectional view of a second embodiment of a device according to the invention.

A second embodiment of the invention is illustrated in FIG. 4. This embodiment differs from that of FIGS. 1 and 3 by the provision of a handle, which is integral with a comb member 10' corresponding to comb member 10 of FIGS. 1 and 2. In this embodiment, comb member portion 24 and diaphragm plate 30 of the embodiment of FIGS. 1 and 2 are eliminated and comb member 10' is made integral with a handle piece 70.

Handle piece 70 is a hollow tubular member which is open at both ends and is provided at the end adjacent comb member 10' with an aperture plate 74 carrying a spike 76. An orifice 78 extends through plate 74 and spike 76 to place the interior of handle piece 70 in communication with the longitudinal passage 22' in comb member 10'.

The tubular passage in handle piece 70 is provided to receive a flexible capsule 80 containing a liquid to be dispensed. Capsule 80 is initially completely sealed and is insertable into the tubular passage in handle piece 70 up to the location of plate 74 and spike 76. After insertion of a capsule 80, an actuating assembly 84 is fitted around handle piece 70 so that a pin 86 forming an integral part of handle piece 70 extends through a helical groove 90 formed in assembly 84. Capsule 80 can also be introduced into piece 70 via a side opening 90 provided therein.

Assembly 84 further includes a bolt portion 94, 96 which fits within the passage in handle piece 70 and which can be advanced along that passage by rotation of assembly 84, with pin 86 riding along the leading edge wall of groove 90. This causes bolt portion 94, 96 to move against capsule 80 so that spike 76 first penetrates the wall of capsule 80 and then capsule 80 is compressed to force liquid contained therein into comb member 10'.

To facilitate removal of assembly 84, for purpose of replacement of capsule 80, groove 90 can extend completely to the left-hand end of assembly 84. This enables assembly 84 to be advanced or retracted past pin 86 to engage assembly 84 with, or disengage assembly 84 from, handle piece 70 and pin 86.

In the embodiment of FIG. 4, the longitudinal passage 22' in comb member 10' has a smaller diameter than in the embodiment of FIGS. 1 and 2 so that only a small amount of liquid is required to fill passages 22' and the tooth passages before being ejected via the tips of the teeth.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A device for applying a liquid to the hair of an individual, said device comprising a comb member and a handle, wherein:

said comb member has an elongate tubular main body with opposed axial ends and a longitudinal axis extending between said ends, and said main body encloses a longitudinal passage which extends along said longitudinal axis, is open at one of said axial ends and is closed at the other one of said axial ends, and a plurality of elongate teeth carried by said tubular main body and extending parallel to one another from said main body in a direction transverse to said longitudinal axis, each of said teeth having a base connected to said main body, a tip remote from said base, and a linear passage extending in a straight line from said base to said tip, said linear passage being open at said base to communicate with said longitudinal passage in said main body and being open at said tip, and each of said teeth having a frustoconic form which tapers from said base to said tip, and said handle comprises:

a handle piece integral with said main body and extending from said open axial end of said main body, said handle piece having a longitudinal axis and an open tubular passage extending along said longitudinal axis;

a plate member having a perforation device for perforating a capsule containing a liquid to be applied upon insertion of the capsule into said tubular passage, said plate member being disposed in said tubular passage adjacent said comb member and having an orifice which places said longitudinal passage in communication with said tubular passage; and a bolt assembly insertable into said tubular passage for pressing the capsule against said perforation device and then compressing the capsule to force liquid from the capsule into said orifice.

* * * * *